United States Patent [19]

Zeilinger

[11] Patent Number: 4,837,997

[45] **Date of Patent: * Jun. 13, 1989**

[54] SEALING SYSTEM INCLUDING T-JOINT CORNER PIECE

[75] Inventor: Alan Zeilinger, Cleveland, Ohio

[73] Assignee: Magic American Corporation, Cleveland, Ohio

[ * ] Notice: The portion of the term of this patent subsequent to Nov. 17, 2004 has been disclaimed.

[21] Appl. No.: 219,144

[22] Filed: Jul. 15, 1988

[51] Int. Cl.[4] ..... E04H 1/00

[52] U.S. Cl. ..... 52/280; 52/35; 52/288; 52/717.1; 403/231; 403/295

[58] Field of Search ..... 52/272, 254, 287, 288, 52/280, 35, 716–718; 403/231, 295, 402, 403

[56] References Cited

U.S. PATENT DOCUMENTS

| | | | |
|---|---|---|---|
| 2,274,317 | 2/1942 | Bonnell | 52/287 |
| 3,716,259 | 2/1973 | Weill et al. | 52/280 |
| 4,642,957 | 2/1987 | Edwards | 52/288 X |
| 4,706,427 | 11/1987 | Zeilinger | 52/288 |

FOREIGN PATENT DOCUMENTS

| | | | |
|---|---|---|---|
| 597105 | 1/1948 | United Kingdom | 52/288 |

*Primary Examiner*—David A. Scherbel

*Assistant Examiner*—Richard E. Chilcot Jr.

*Attorney, Agent, or Firm*—Renner, Otto, Boisselle & Sklar

[57] ABSTRACT

A sealing system for sealing the joints defined by three intersecting structural surfaces such as the top surface of a tub and two adjoining walls includes three generally L-shaped sealing strips and a corner piece for covering the corner where the joints meet and the end portions of the three sealing strips. The sealing strips and corner piece are held in place against the structural surfaces with a suitable adhesive and have flexible lips along their edges which press against the underlying surfaces adjacent the joints to be sealed. The corner piece has three connected walls, each one generally parallel to one of the three structural surfaces which define the joints to be sealed. Two lands project rearwardly from the corner piece, each land projecting toward a respective one of the structural surfaces. Each land defines the minimum distance between the end of one of the sealing strips and the corner, and between them the lands define a space for receiving the third sealing strip. The lands are contoured to match the contour of the third sealing strip. The corner piece also includes flanges which cover the end portions of the first two sealing strips.

15 Claims, 3 Drawing Sheets

SEALING SYSTEM INCLUDING T-JOINT CORNER PIECE

FIELD OF THE INVENTION

The present invention relates generally to sealing systems to seal the joints around bathtubs, showers or sinks and specifically to a system which includes L-shaped sealing strips and a corner piece which will cover and seal the end portions of three such sealing strips where they meet in a corner.

BACKGROUND OF THE INVENTION

U.S. Pat. No. 4,706,427 invented by the inventor hereof and assigned to the assignee of this application discloses a sealing system for sealing the horizontal joints between the top face of a bathtub or the like and adjacent walls. The entire disclosure of this patent is incorporated into this application by reference.

U.S. Pat. No. 4,706,427 does not address sealing the vertical joint between two horizontal joints. However, when the vertical joint is not watertight, there is a need for additional sealing.

SUMMARY OF THE INVENTION

The present invention provides a sealing system for sealing three intersecting joints such as occur where two upright walls meet at the top of a bathtub. The system includes three generally L-shaped sealing strips with adhesive to hold them in place along the three joints and a corner piece to cover and seal the corner where the three strips meet. The corner piece has three connected walls each of which is parallel to one of the upright walls or to the top of the tub. Lands or ribs project from the back of the corner piece to space it from the walls and to position the corner piece with respect to the sealing strips. When installed two of the strips stop short of the corner while the third strip may reach all the way to the corner. The corner piece overlaps the end portions of each of the sealing strips. Adhesive secures the corner piece to the strips to make a watertight seal.

DESCRIPTION OF THE PREFERRED EMBODIMENT

Figure 1:
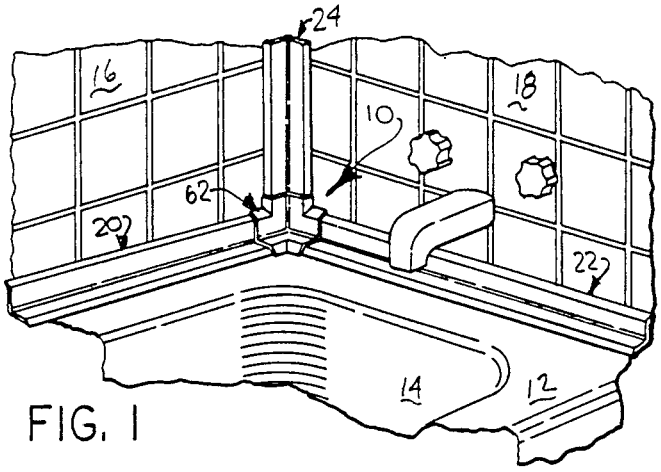
FIG. 1 is a perspective illustration of the sealing system of the present invention including three sealing strips and a corner piece installed to seal the joints between the top of a bathtub and two upright surfaces.

FIG. 1 illustrates a sealing system 10 suitable for sealing three intersecting joints such as those defined by the top surface 12 of a bathtub 14 and adjacent walls 16 and 18. The walls 16 and 18 are generally vertical and perpendicular to each other, while the top surface 12 of the tub is generally horizontal. Although the sealing system 10 is shown sealing the joints around a bathtub, it could equally find application in other similar corners such as around the perimeter of a sink which has a backsplash or in a shower stall.

The sealing system 10 includes three generally L-shaped sealing strips 20, 22, and 24, of the sort disclosed in U.S. Pat. No. 4,706,427. The sealing strips 20-24 are generally similar and only the sealing strip 20 will be described. The sealing strip 20 (FIG. 2) includes a pair of mutually perpendicular legs 26 and 28 bounded by flexible lips, 30 and 32, respectively. It is contemplated that the sealing strips 20–24 will be identical, having the same leg length and leg thickness. However, it is also possible to manufacture the sealing system 10 with sealing strips having different leg lengths, for example, longer leg lengths on the sealing strips 20 and 22 to permit sealing of larger gaps between the tub surface 12 of the bathtub and the adjacent edge of the walls 16 and 18.

Figure 3:
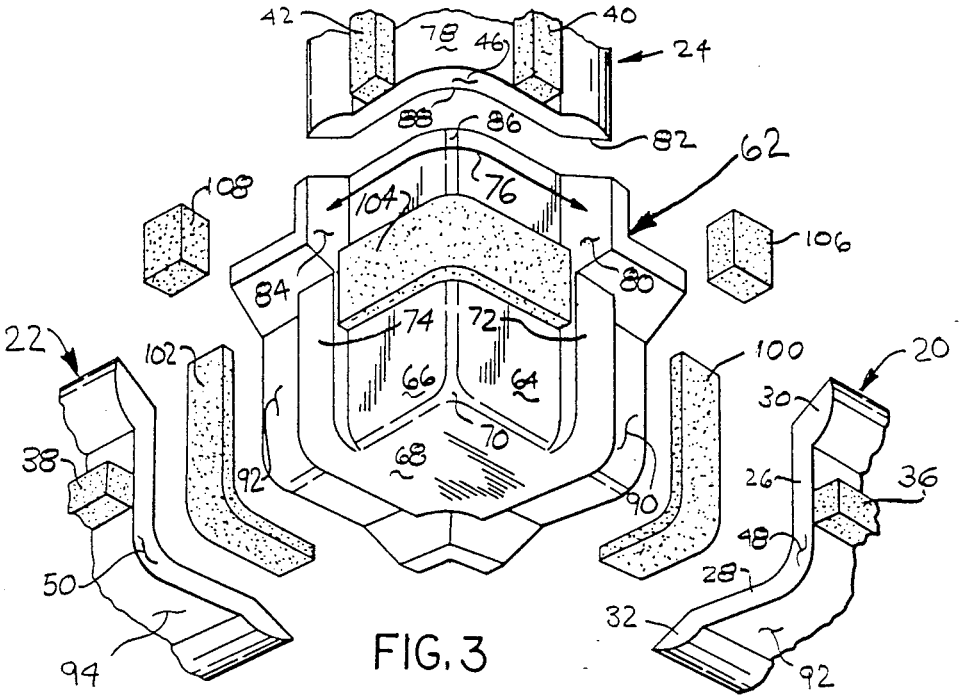
FIG. 3 is an enlarged, fragmentary exploded rear perspective illustration of the corner piece and sealing strips of FIG. 1 also showing the various strips of adhesive used to assemble the sealing system.
Figure 4:
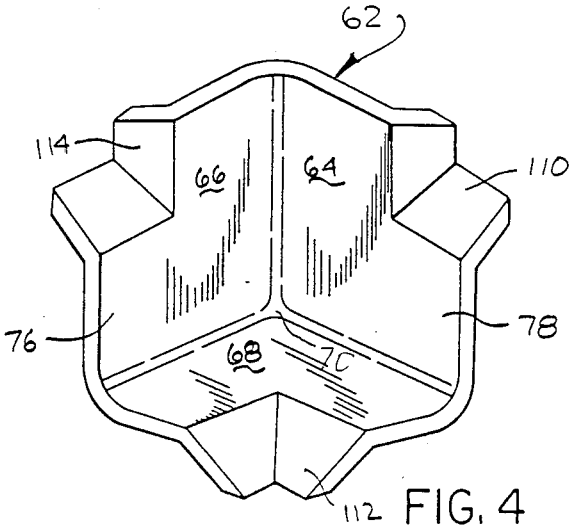
FIG. 4 is an enlarged front perspective view of the corner piece of FIG. 1.
Figure 5:
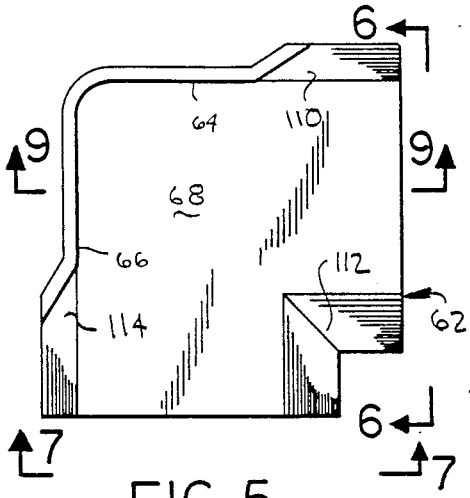
FIG. 5 is an enlarged top plan view of the corner piece of FIG. 1.
Figure 6:
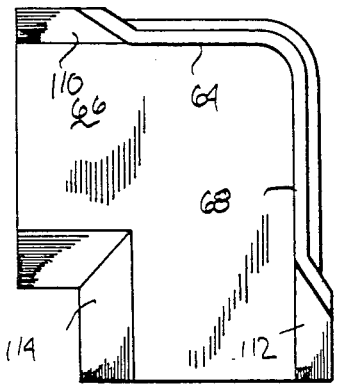
FIG. 6 is a view of the corner piece of FIG. 5 looking in the direction of arrows 6—6.
Figure 7:
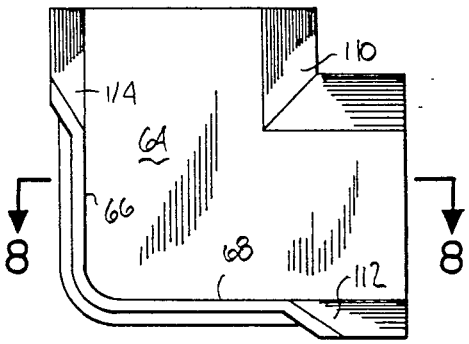
FIG. 7 is a view of the corner piece of FIG. 5 looking in the direction of arrows 7—7.

A suitable adhesive such as a butyl adhesive is used to secure the strips 20–24 in place. As best seen in FIG. 3, the adhesive may be applied to sealing strip 20 in the form of a bead 36 along the back side of the vertical leg 26. Sealing strip 22 likewise has a single bead 38 of adhesive on the back side of its vertical leg. The vertical sealing strip 24 has two adhesive beads 40 and 42, one along each leg. The adhesive is waterproof and thus provides a seal between the sealing strips 20–24 and the respective surfaces 16 and 18.

When installing the sealing strips, the vertical sealing strip 24 (FIG. 2) may be installed first. Its lowermost end face 46 may rest on or near the top face 12 of the tub 14. The two horizontal sealing strips 20 and 22 are installed next. Their ends 48 and 50, respectively, are spaced from the corner by a distance which is greater than the adjacent leg lengths of the vertical strip 24.

Because of the described placement of the sealing strips 20–24, there remain exposed spaces 52 and 54 along each wall surface 16, 18. The space 52 is between the flexible lip (on the left as viewed in FIG. 2) of the vertical sealing strip 24 and the end face 48 of the sealing strip 20. The space 54 is between the flexible lip (on the right as viewed in FIG. 2) of the vertical sealing strip 24 and the end face 50 of the sealing strip 22. In addition, there is a roughly square area 56 of the top face of the tub 12 between the ends 48 and 50 of the sealing strips 20 and 22 which is also exposed. A corner piece 62 (FIG. 1) is contoured to fit these areas.

As shown in greater detail in FIGS. 3–9, the corner piece 62 includes generally mutually perpendicular walls 64, 66 and 68 which meet at a rounded corner 70. Each of the walls 64–68 is generally parallel to one of the surfaces 12, 16, and 18 which define the corner to be sealed. Upon installation, wall 68 of the corner piece is generally parallel to the top surface 12 of the tub 14, wall 66 is generally parallel to the surface of the end wall 18 of the tub enclosure, and wall 64 is generally parallel to the surface of wall 16 of the tub enclosure.

Ribs or lands 72 and 74 (FIGS. 3 and 8) extend rearwardly from the walls 64 and 66, respectively, intermediate the ends thereof and extend vertically from bottom wall 68 upward, and are proportioned to fit into the spaces 52 and 54 (FIG. 2), respectively.

The lands 72 and 74 serve as boundaries for elements of the corner piece 62. First the lands 72 and 74 define a passage 76 between them for receiving the lower end portion 78 of the vertical strip 24. The space 76 may be contoured to fit the external shape of the sealing strip 24. To this end, the face 80 of land 72 is beveled to match and fit against the beveled face 82 of the flexible edge lip of strip 24. The faces 84 of land 74 is similarly beveled. A curved connection 86 is also provided between walls 64 and 66 of the corner piece 62 having a curvature matching the curve 88 connecting the legs of the sealing strip 24. Further the side walls 64 and 66 are of reduced thickness in the region of passage 76 as compared to the bottom wall 68. See FIGS. 8 and 9.

The lands 72 and 74 also serve as inner boundaries for flanges 90 and 92, respectively. The flanges 90 and 92 extend from the respective side walls 64, 66 and the bottom wall 68 to overlap and cover end portions 92 and 94 (FIGS. 2 and 3) of the sealing strips 20 and 22, respectively. Also, such flanges 90 and 92 have front faces which are coplanar with the front or outer faces of the walls 64, 66, and 68, and are thinner than the bottom wall 68. See FIGS. 8 and 9.

The lands 72 and 74 project rearwardly from the walls 64 and 66 a distance approximately equal to the thickness of the legs 26 and 28 of the sealing strips and define the inward limit for the ends 48 and 50 of the strips 20 and 22. See FIG. 3. During installation of a thin bead 100 of butyl adhesive may be applied to the back surface of flange 90 to seal between the flange and the end portion 92 of the sealing strip 20. A similar thin strip of butyl adhesive 102 may be applied to the back of flange 92 to seal the end portion 94 of the sealing strip 22 to the corner piece 62. Further a thin strip of adhesive 104 may be applied to the backs of walls 64 and 66 in the space 76 between the lands 72 and 74.

When the corner piece 62 is pressed against the sealing strips 20–22, the thin strips of adhesive 100–104 are flattened further so that the back surface of the legs 26 of the sealing strips 20 and 22 are nearly flush with the rearmost surface of the lands 72 and 74. Beads of adhesive 106 and 108 the same thickness as the beads 36 and 38 which extend the length of the sealing strips 20 and 22 may be placed on the surface of the lands 72 and 74. These beads 36, 38, 106 and 108 are made thick enough that they can seal against uneven surfaces such as the tiled surface shown for walls 16 and 18.

Figure 9:
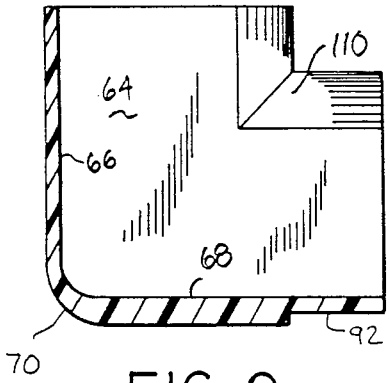
FIG. 9 is a sectional view of the corner piece of FIG. 5 looking in the direction of arrows 9—9.
Figure 8:
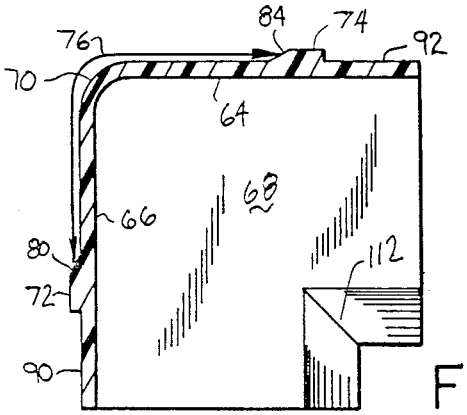
FIG. 8 is a sectional view of the corner piece of FIG. 7 looking in the direction of arrows 8—8.

The flanges 90 and 92 include those portions of walls 64 and 66 which extend beyond the lands 72 and 74, respectively. The flanges 90 and 92 also include the reduced thickness, outer portions of the bottom wall 68 which are remote from the corner 70, as shown in FIGS. 3 and 9. The flanges 90 and 92 cover any space between the ends 48 and 50 of the sealing strips 20 and 22 and the lands 72 and 74 to accommodate some error in measuring, cutting, or accurately positioning sealing strips 20 and 22.

Figure 2:
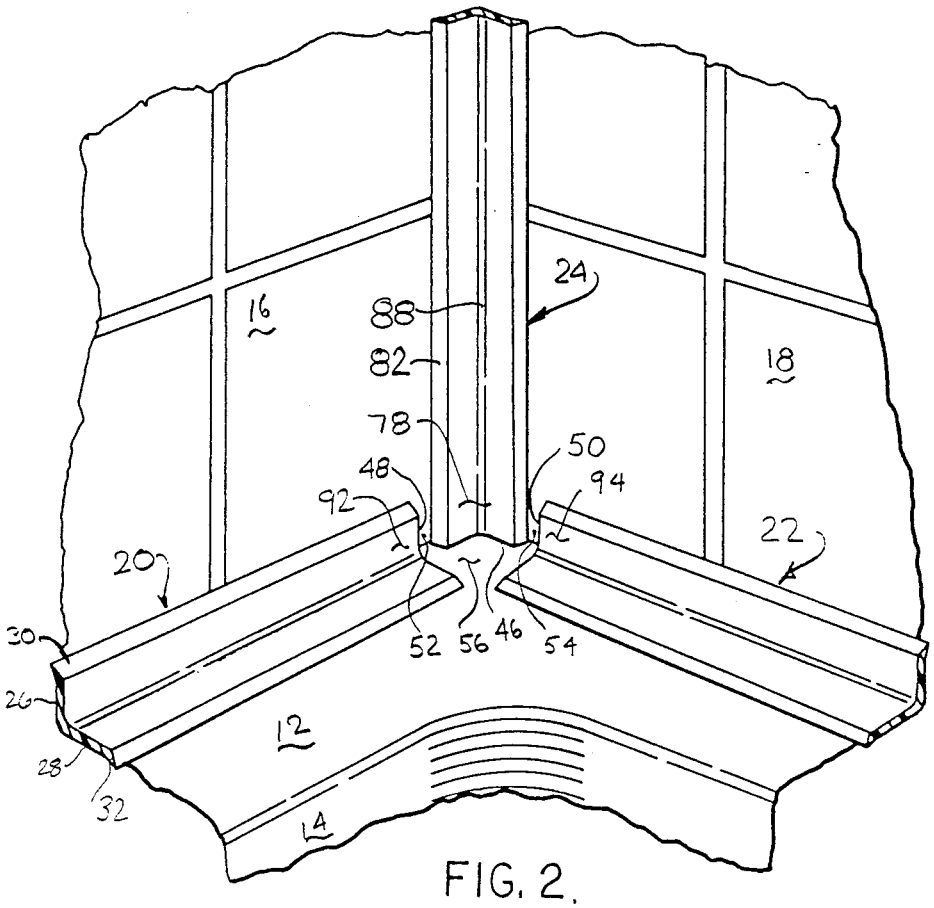
FIG. 2 is an enlarged perspective illustration of the sealing strips of FIG. 1 before the corner piece is installed.

The vertical sealing strip 24 fits behind the corner piece 62 in the space 76 and may extend downward all the way to the top surface 12 of the tub 14 as shown in FIG. 2 or may be shorter as desired. In a typical system the flanges 90 and 92 extend laterally approximately $\frac{3}{8}$ inch. About one half of this length is needed to bond properly to the adhesive beads 100 and 102 (FIG. 3). This leaves about 3/16 inch to accommodate measuring, cutting and installation error. The corner piece 62 may have a total height of approximately $\frac{7}{8}$ inch. Since only about 3/16 inch overlap is needed to provide an adequate seal with adhesive 104, about 11/16 inch is available for error in positioning of the vertical sealing strip 24.

The corner piece 62 may also have beveled lips 110, 112, and 114. See FIGS. 4, 5 and 7. These beveled lips press against the flexible edges, e.g. 30 and 32, of the sealing strips to help hold them in place. The beveled edges 110–114 may be slightly rounded to provide a smoother exterior surface and to facilitate manufacturing.

Although the invention has been shown and described with respect to a certain preferred embodiment, it is obvious that equivalent alterations and modifications will occur to others skilled in the art upon the reading and understanding of the specification. The present invention includes all such equivalent alterations and modifications, and is limited only by the scope of the claims.

What is claimed is:

1. A sealing system for sealing a junction between a horizontal surface such as a top surface of a bathtub, countertop or sink and two adjacent vertical surfaces, the vertical surfaces and horizontal surface being substantially mutually perpendicular and defining two horizontal joints, one vertical joint, and a corner at an intersection of the horizontal and vertical joints, the system comprising:

three generally L-shaped sealing strips each having a pair of legs extending lengthwise parallel to a respective one of the joints, a first one of the strips sealing the vertical joint and extending vertically from the corner, the second and third strips each sealing a respective one of the horizontal joints and each stopping a predetermined distance short of the corner, and a one piece corner piece having a first wall adjacent the horizontal surface and second and third walls respectively approximately parallel to the adjacent vertical surfaces, the first, second and third walls having side edge flanges for receipt of an end portion of the second and third sealing strips behind the flanges with the flanges overlapping the second and third sealing strips, the second and third walls each having a land projecting rearwardly therefrom defining a passage between the lands for receipt of an end portion of the first sealing strip behind the second and third walls.

2. The system of claim 1, wherein the walls of the corner piece are generally planar and orthogonally intersecting.

3. The system of claim 1 including an adhesive bead securing the second and third sealing strips to an adjacent vertical surface and a pair of adhesive beads securing the first sealing strip to the vertical surfaces on opposite sides of the vertical joint, adhesive between the flanges of the corner piece and the second and third sealing strips, and adhesive between the lands on the second and third walls.

4. The system of claim 1 wherein the legs of the sealing strips include generally planar main body portions which are approximately mutually perpendicular and a flexible peripheral lip extending the length of an edge of each main body portion obliquely to the plane of the respective main body portion, and the corner piece includes flared edges for overlapping and forming continuations of the peripheral lips.

5. The system of claim 1 wherein the legs of the first sealing strip are adhesively adhered to the respective vertical walls and a lowermost end face of the first sealing strip abuts the horizontal surface.

6. A one piece corner piece for filling a gap between ends of three generally L-shaped strips which seal joints between a horizontal surface and a pair of vertical surfaces, the surfaces defining one vertical and two horizontal joints and meeting at a corner, each one of the strips having two legs, a first two of the strips extending longitudinally along and sealing two horizontal joints and having ends positioned short of the corner by a distance greater than a leg length of the third strip, and the third strip extending along a vertical joint and having an end portion with vertical edges extending between the ends of the first two strips, the corner piece having a base portion proportioned to cover the horizontal surface between end portions of the first two strips, and a pair of side walls connected to each other and extending generally perpendicular from the base portion and to each other, each side wall having a land projecting rearwardly therefrom defining a passage between the lands for receipt of an end portion of the third strip behind the side walls between the lands.

7. The corner piece of claim 6 including adhesive means attached to the base and the lands for securing the corner piece to the horizontal and vertical surfaces.

8. The corner piece of claim 6 including flange means extending from the base and the side walls for covering an end portion of each of the first two strips.

9. The corner piece of claim 8 wherein the flanges have shaped ends to follow the contour of flexible lips tapering from the edges of the strips.

10. The corner piece of claim 6 wherein the flanges are shaped to follow the contour of lips on the edges of the strips.

11. A corner piece for covering and sealing a junction of three generally L-shaped sealing strips which seal joints between two generally upright surfaces and a generally horizontal surface, the joints meeting to define a corner, each of the sealing strips having two legs, the corner piece having three connected walls, each generally perpendicular to each other, and a pair of lands projecting rearwardly from two of the walls of the corner piece, the two lands together defining therebetween a space for receiving an end portion of one of the sealing strips behind the two walls.

12. The corner piece of claim 11 wherein the walls include flange means for overlapping end portions of the other two sealing strips.

13. The corner piece of claim 12 wherein the flange means are contoured to match the contour of the other two sealing strips.

14. The corner piece of claim 12 wherein the lands are contoured to match the contour of the one sealing strip.

15. The corner piece of claim 11 wherein the lands have substantially the same thickness as the thickness of the end portions of the sealing strips.

* * * * *